US008961236B2

(12) United States Patent
Lu

(10) Patent No.: US 8,961,236 B2
(45) Date of Patent: Feb. 24, 2015

(54) CONNECTOR PREVENTING ELECTROSTATIC DISCHARGE

(75) Inventor: Chiu-Ming Lu, Lisle, IL (US)

(73) Assignee: Molex Incorporated, Lisle, IL (US)

( * ) Notice: Subject to any disclaimer, the term of this patent is extended or adjusted under 35 U.S.C. 154(b) by 160 days.

(21) Appl. No.: 13/697,711

(22) PCT Filed: May 16, 2011

(86) PCT No.: PCT/US2011/036621

§ 371 (c)(1),
(2), (4) Date: Jan. 28, 2013

(87) PCT Pub. No.: WO2011/143649

PCT Pub. Date: Nov. 17, 2011

(65) Prior Publication Data

US 2013/0122752 A1 May 16, 2013

(30) Foreign Application Priority Data

May 14, 2010 (TW) ..... 99209092 U

(51) Int. Cl.

| | |
|---|---|
| ***H01R 24/00*** | (2011.01) |
| ***H01R 33/00*** | (2006.01) |
| ***H01R 13/516*** | (2006.01) |
| ***H01R 13/648*** | (2006.01) |

(Continued)

(52) U.S. Cl.

CPC ..... *H01R 13/516* (2013.01); *H01R 13/6485* (2013.01); *H01R 12/724* (2013.01); *H01R 13/6596* (2013.01)

USPC ..... 439/660; 439/607.4

(58) Field of Classification Search

CPC ..... H01R 23/7073; H01R 23/6873; H01R 13/516; H01R 23/02; H01R 13/65802

USPC ..... 439/660, 607.35, 607.4

See application file for complete search history.

(56) References Cited

U.S. PATENT DOCUMENTS

| | | | |
|---|---|---|---|
| 5,228,872 | A | 7/1993 | Liu |
| 7,651,371 | B2 | 1/2010 | Yi et al. |

(Continued)

FOREIGN PATENT DOCUMENTS

| | | | |
|---|---|---|---|
| JP | 2003-197318 | A | 7/2003 |
| TW | M356277 | | 5/2009 |

(Continued)

OTHER PUBLICATIONS

International Search Report for PCT/US2011/036621.

*Primary Examiner* — Hae Moo Hyeon
(74) *Attorney, Agent, or Firm* — Stephen L. Sheldon

(57) ABSTRACT

A connector, comprising an insulative body, a plurality of conduction terminals, and a shielding shell. The tongue panel of the insulative body comprises a first surface and a second surface. The conduction terminals are arranged as first conduction terminals in the front row and second conduction terminals in the back row, the first conduction terminals comprising a first contact portion, a bending portion bent and extended from the rear edge of the first contact portion, a first fixing portion and a first welding portion. The first surface of the tongue panel is provided with a first receiving slot for receiving the first fixing portion and a recess portion disposed at the front end of the first receiving slot, the recess portion is formed as an opening for the first contact portion to nm through the opening from the first surface to be fixed onto the second surface.

11 Claims, 10 Drawing Sheets

(51) Int. Cl.
*H01R 12/72* (2011.01)
*H01R 13/6596* (2011.01)

(56) References Cited

U.S. PATENT DOCUMENTS 7,682,163 B2 * 3/2010 Hou et al. ..... 439/79
7,686,656 B2 3/2010 Zheng et al.
7,833,065 B2 * 11/2010 Lin et al. ..... 439/639
7,883,371 B1 * 2/2011 Chen et al. ..... 439/607.41
7,988,499 B2 * 8/2011 Lin et al. ..... 439/701
8,002,589 B1 * 8/2011 Yu et al. ..... 439/660
8,133,078 B2 * 3/2012 Lin et al. ..... 439/660
8,147,276 B2 * 4/2012 Wang et al. ..... 439/660
2004/0171300 A1 9/2004 Brandt et al.
2008/0268707 A1 10/2008 Wu et al.

FOREIGN PATENT DOCUMENTS

TW M359067 6/2009
TW M367470 10/2009

* cited by examiner

CONNECTOR PREVENTING ELECTROSTATIC DISCHARGE

RELATED APPLICATIONS

This application claims priority to Taiwan Patent Application No. 99209092, filed May 14, 2010, which is incorporated herein by reference in its entirety.

TECHNICAL FIELD

The present invention relates to a connector, and particularly to a socket connector capable of preventing electrostatic discharge (ESD), easy to be assembled and capable of lowering cost.

DESCRIPTION OF THE RELATED ART

Electric connectors are installed on circuit boards in various electronic devices. Said electric connector has a connecting space, while conduction terminals thereof are exposed in the connecting space for electrical connection with terminals of a connector to be connected with. For example, the Republic of China Utility Model M367470 (Application No. 98209078) discloses a socket of an electric connector, in which an insulative terminal seat primarily comprises a front wall and a rear wall and the top end of the front wall extends horizontally to form an upper tongue panel. The upper tongue panel comprises a bottom surface and a front end surface, and the external side end and internal side end of the bottom surface are provided with a plurality of first terminal slots and a plurality of second terminal slots, respectively, for containing first and second terminals, respectively.

Looking at FIG. 1. One end of the above first terminal 1*a* is a contact member 11*a* with a 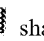 shape, the contact member 11*a* comprises a front panel 111*a*, a back panel 112*a* and a bottom panel 113*a*, two sides of the bottom panel 113*a* can be inserted into corresponding grooves (not shown) of the first terminal slots, while external side surfaces of the front panel 111*a* and the bottom panel 113*a* are for electrical contact.

As shown in FIG. 2, however, the front panel 111*a* of this type of contact member 11*a* is exposed at the front end of the tongue panel 21*a*, while connecting with a plug connector (not shown), ESD tends to occur between the front panel 111*a* of the first terminal 1*a* and the steel casing of the plug connector (not shown), which could likely damage electronic components on a circuit board, in particular components on an integrated circuit.

Moreover, the Republic of China Patent Application No. 97141258 also discloses an electric connector, which can be connected with a connecting plug, comprising an insulative body and a plurality of conduction terminals installed on the insulative body, the insulative body comprises a base portion and a tongue panel provided with a front surface, and the tongue comprises a first side and a second side perpendicular to the front surface, respectively. These terminals comprise a row of first terminals and a row of second terminals, wherein the first terminals are installed on the insulative body by means of assembly. As shown in FIG. 3 and FIG. 4, the first terminal 1*b* comprises a first portion 11*b* and a second portion 12*b* disposed on the first side 212*b* and the second side 213*b* of the tongue panel 21*b*, respectively, wherein the first portion 11*b* and the second portion 12*b* of the first terminal 1*b* are connected through a connecting portion 13*b* at the front end of the first terminal 1*b* and close to the front surface 211*b*, and said connecting portion 13*b* is perpendicular to the front surface 211*b*.

However, the connecting portion 13*b* and the first terminal 11*b* of the first terminal according to the above design are both bent and extended from one side of the second portion 12*b*. Since this type of conduction terminals is typically pressed and bent from one strip of metal band, such a structural design bent and extended in a side direction will increase the horizontal distance between two neighboring first terminals on the metal band, and lower the material utilization rate of the metal band, which is not good for environmental protection and will increase manufacturing cost. On the other hand, if the horizontal distance between two neighboring first terminals on the metal band is greater than the horizontal distance between two neighboring first terminals when installed onto the insulative body, the first terminals have to be cut off from the metal band and then installed onto the insulative body during assembly one by one. It would be impossible to install five first terminals together onto the insulative body through a continuous band, which results in inconvenient assembly. Therefore, certain individuals would appreciate an improved connector.

SUMMARY OF THE INVENTION

A connector, comprising an insulative body, a plurality of conduction terminals disposed on said insulative body, and a shielding shell that wraps around the peripheral surface of the insulative body. The insulative body comprises a main body and a tongue panel, the tongue panel comprises a front end surface that is far away from the main body, a first surface perpendicular to the front end surface, and a second surface opposite the first surface. The conduction terminals are arranged, in the extension direction of the tongue panel, as first conduction terminals in the front row and second conduction terminals in the back row, the first conduction terminals comprising a flat panel-like first contact portion, a bending portion bent and extended from the rear edge of the first contact portion, a first fixing portion extended from the end of the bending portion, and a first welding portion bent and extended from the rear edge of the first fixing portion, the second conduction terminals comprising an elastic second contact portion, a second fixing portion, and a second welding portion, and the first contact portion and the second contact portion are disposed on the second surface of the tongue panel. The first surface of the tongue panel is provided with a plurality of first receiving slots for receiving the first fixing portions of the first conduction terminals and a plurality of recess portions disposed at the front end of the first receiving slots and open to the second surface, characterized in that the recess portion is formed as an opening on the first surface, said opening is bigger than the first contact portion of the first conduction terminal for the first contact portion of the first conduction terminal to run through the opening of the recess portion from the first surface to be fixed onto the second surface of the tongue panel. In an embodiment, the first contact portion, the bending portion, the first fixing portion and the first welding portion of the first conduction terminal are connected end to end with their axis lines all on the same plane.

DETAILED DESCRIPTION OF THE PREFERRED EMBODIMENTS

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

One advantage of the depicted disclosure is that the assembly structure between the recess portions of the insulative body and the first contact portions of the first conduction terminals keeps the first conduction terminals from being exposed at the front end surface of the tongue panel, which can prevent ESD.

Secondly, the first contact portion, the bending portion, the first fixing portion and the first welding portion of the first conduction terminal are connected end to end with their axis lines all on the same plane, such that when the first conduction terminals are pressed and bent from a metal band, the horizontal distance between two neighboring first terminals can be reduced to improve the material utilization rate of the metal band and first conduction terminals can be assembled to the insulative body together through a continuous metal band, making the assembly further convenient.

Figure 1:
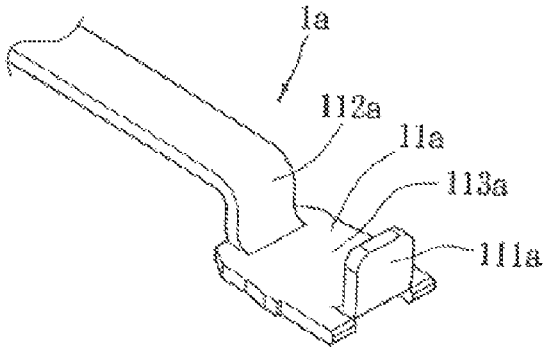
FIG. 1 (Prior Art)
FIG. 1 is a perspective view of the first terminal of the socket of a prior art electric connector
Figure 2:
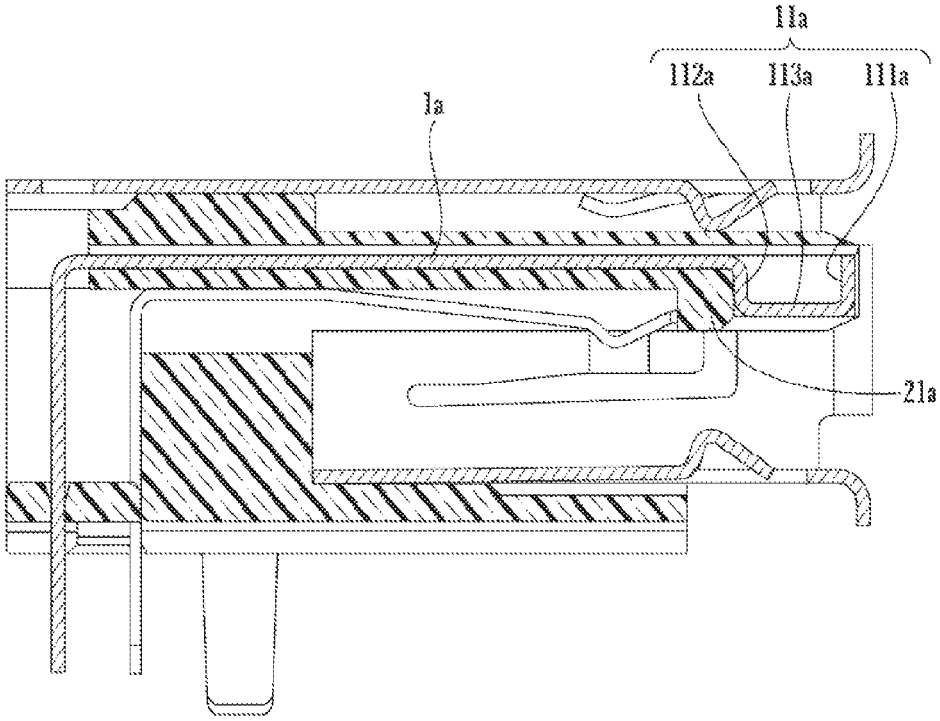
FIG. 2 (Prior Art)
FIG. 2 is a sectional view of the socket of a prior art electric connector.
Figure 3:
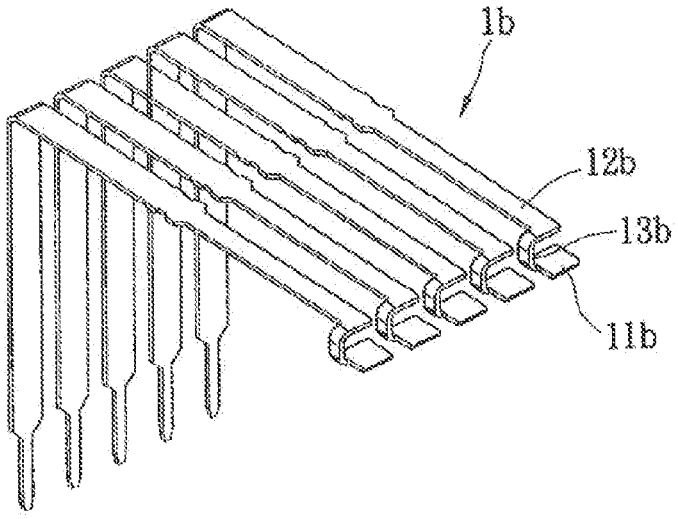
FIG. 3 (Prior Art)
FIG. 3 is a perspective view of the first terminal of a prior art electric connector.
Figure 4:
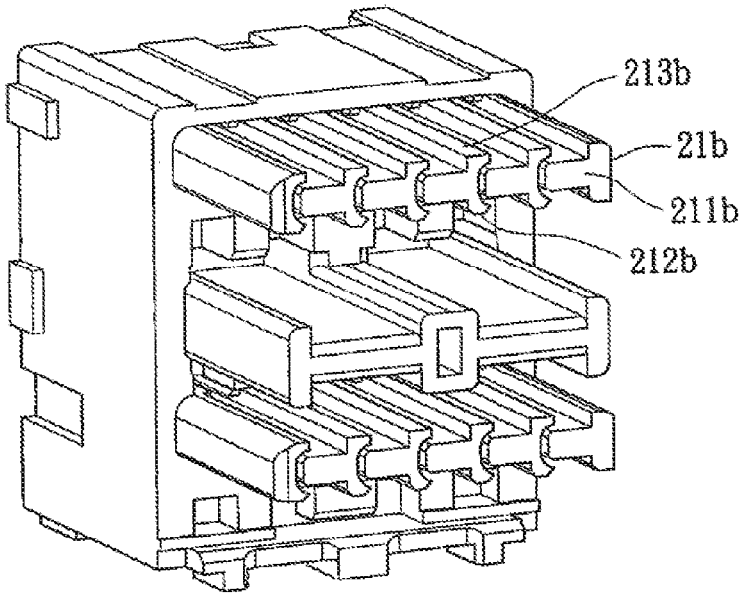
FIG. 4 (Prior Art)
FIG. 4 is a perspective view of the insulative body of a prior art electric connector.
Figure 5:
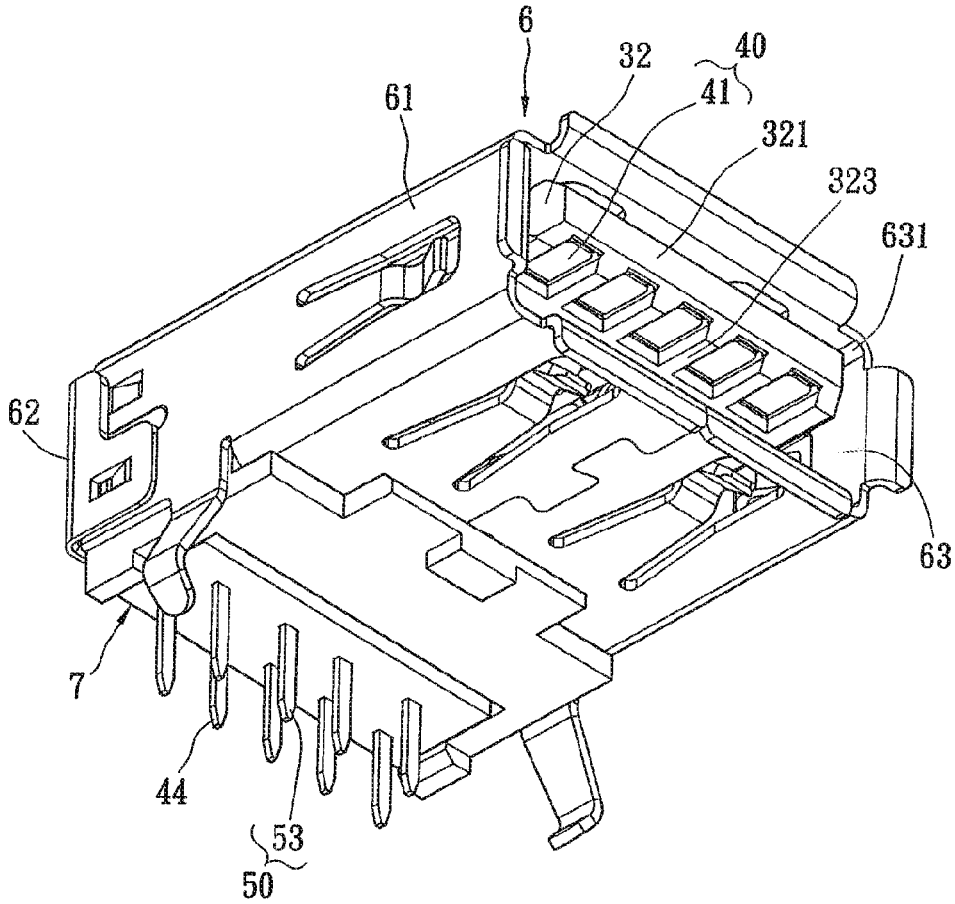
FIG. 5 is an assembled perspective view of an embodiment of a connector.
Figure 6:
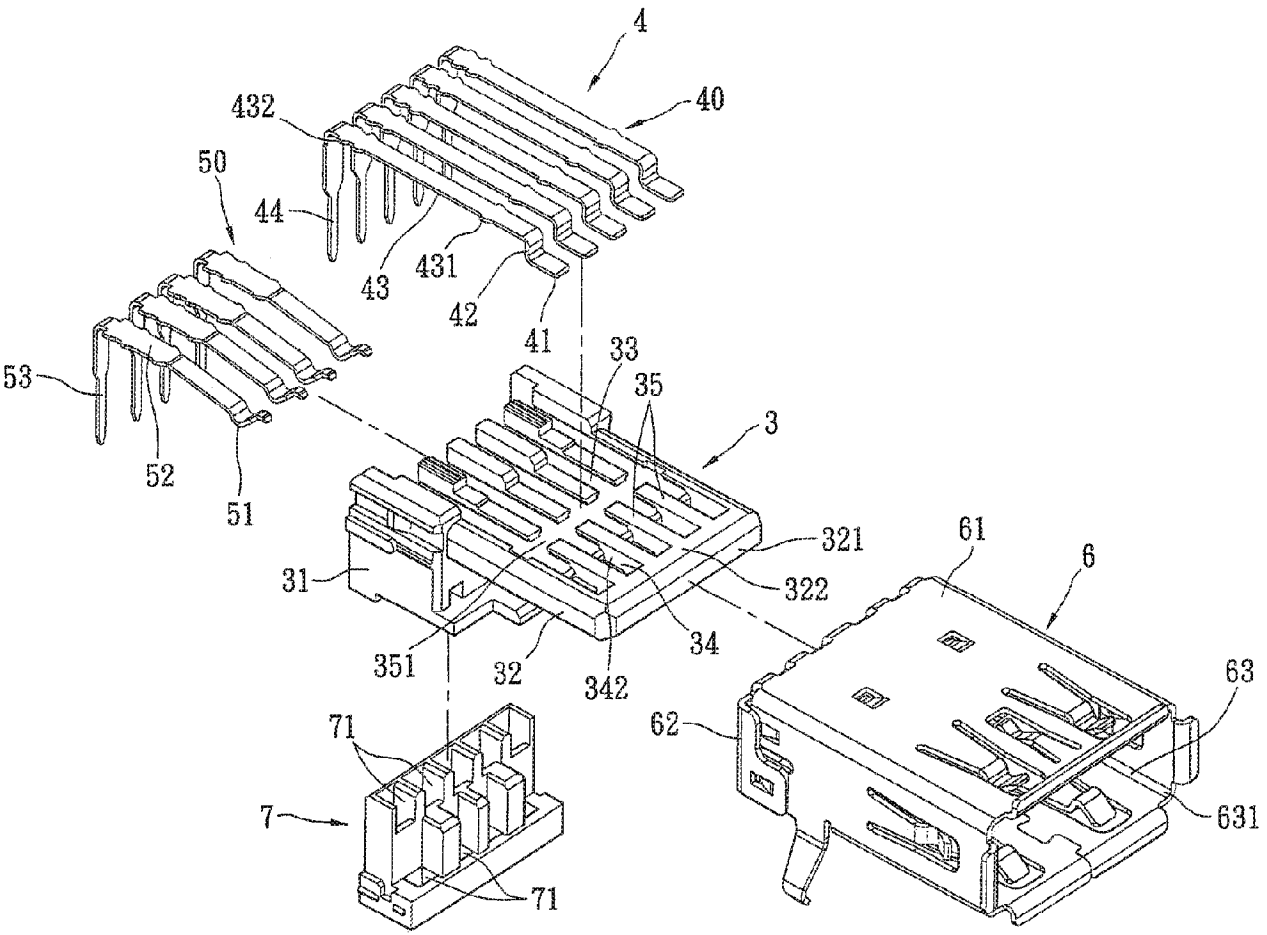
FIG. 6 is an exploded perspective view of an embodiment of a connector.
Figure 7:
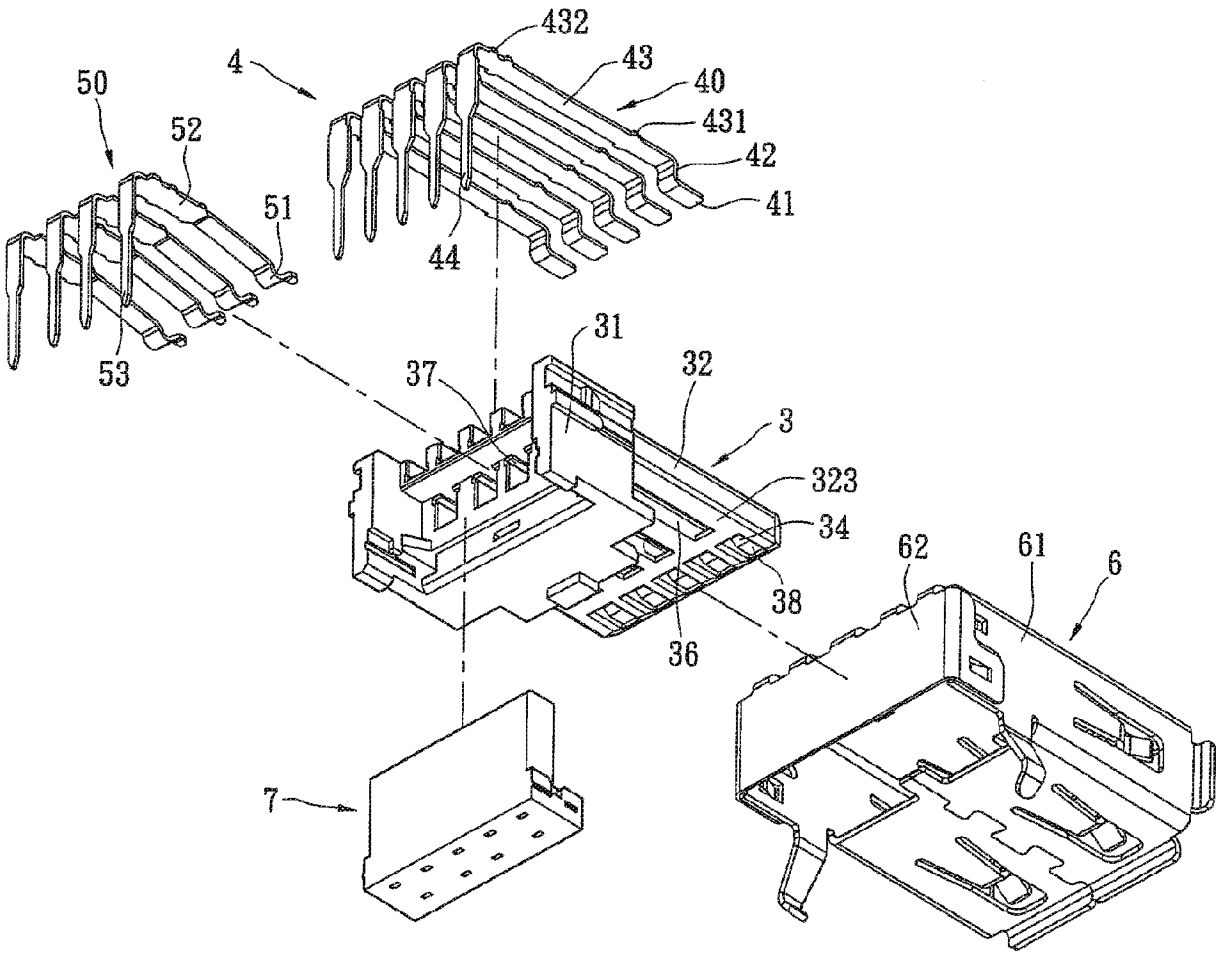
FIG. 7 is an exploded perspective view of an embodiment of a connector.

As shown in FIG. 5 through FIG. 7, a connector is disclosed and, its preferred embodiment being an Universal Serial Bus (USB) 3.0 socket connector, comprising an insulative body 3, a plurality of conduction terminals 4 and a shielding shell 6.

The insulative body 3 comprises a main body 31 and a tongue panel 32 extended forwardly from the main body 31, wherein the tongue panel 32 comprises a front end surface 321 that is far away from the main body 31, a first surface 322 perpendicular to the front end surface 321, and a second surface 323 opposite the first surface 322 (as shown in FIG. 7). Moreover, the insulative body 3 is provided with a plurality of first receiving slots 33 and a plurality of recess portions 34 on the first surface 322 of the tongue panel 32, said recess portion 34 being formed as an opening 342 on the first surface 322, said recess portion 34 open to the second surface 323 and open to the first receiving slot 33.

Figure 8:
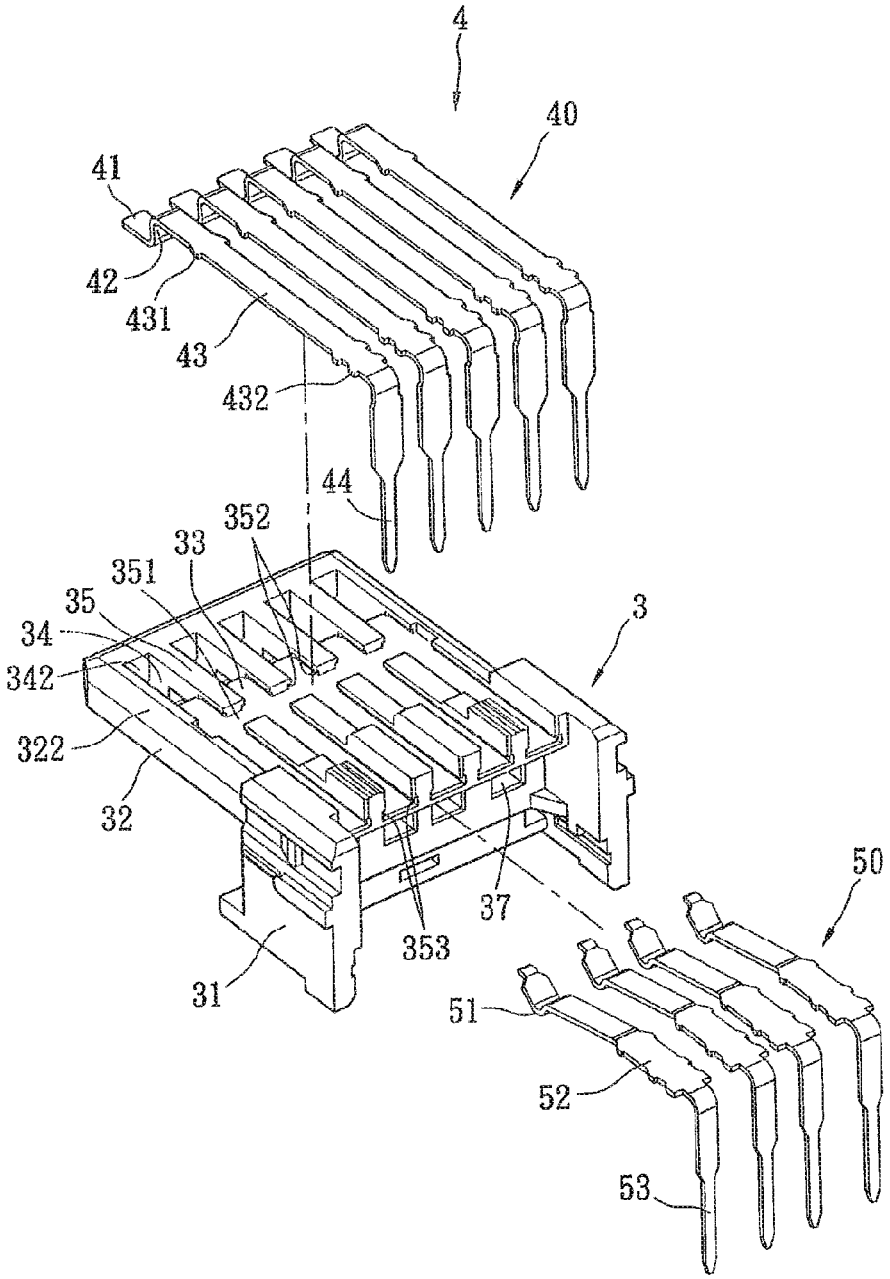
FIG. 8 is an exploded view of an embodiment of the insulative body and the conduction terminals of a connector.

In a further aspect, a plurality of raised strips 35 are disposed by extending in a front to back direction on the first surface 322 of the tongue panel 32, the above first receiving slots 33 are formed between these raised strips 35 on the first surface 322, and a notch 351 is formed in the central portion of each of these raised strips 35. Two side walls of the rear end portions and the central portions of these raised strips 35 that form the first receiving slots 33 are provided with a front groove 352 and a rear groove 353, respectively (as shown in FIG. 8) with the front groove 352 disposed at the front end of the notch 351 and the rear grove 353 disposed at the rear end of the notch 351. The insulative body 3 is further provided with a plurality of second receiving slots 36 on the second surface 323 of the tongue panel 32, the insulative body 3 is further provided with a plurality of fixing holes 37 (as shown in FIG. 7) with the fixing holes 37 open to corresponding second receiving slots 36. The insulative body 3 is further provided with a plurality of grooves 38 on the second surface 323 of the tongue panel 32, these grooves 38 are disposed at the front end of the second receiving slots 36, and these recess portions 34 are of a partially closed structure on the second surface 323 with the front ends thereof open to the corresponding grooves 38 and the rear ends thereof partially open to neighboring second receiving slots 36. Moreover, the opening 342 of the recess portion 34 of the insulative body 3 is of a closed structure at the front end of the first surface 322, more specifically, the front end surface 321 of the tongue panel 32 is of a closed structure that is not open to these recess portions 34.

The conduction terminals 4 are grouped into five first conduction terminals 40 in the front row and four second conduction terminals 50 in the back row, the first conduction terminals 40 comprising a flat panel-like first contact portion 41, a bending portion 42, a first fixing portion 43, and a first welding portion 44, the second conduction terminals 50 comprising an elastic second contact portion 51, a second fixing portion 52, and a second welding portion 53. The bending portion 42 is formed by bending and extending vertically in a upward direction from the rear edge of the first contact portion 41, the first fixing portion 43 is formed by extending horizontally in a backward direction from the end of the bending portion 42, and the first welding portion 44 is formed by extending vertically in a downward direction from the rear edge of the first fixing portion 43. The second fixing portion 52 is formed by extending from the end of the second contact portion 51, and the second welding portion 53 is formed by bending and extending vertically in a downward direction from the rear edge of the second fixing portion 52. The first fixing portion 43 of each of the first conduction terminals 40 can be provided with front spurs 431 and rear spurs 432 that are opposite to each other by projecting from two sides of the central portion and the rear end thereof.

The shielding shell 6 is formed by pressing and bending a metal panel, which can comprise four board portions 61 and one backboard 62.

As depicted, the connector further comprises a positioning base 7, which is provided with positioning slots 71 arranged in front and rear rows.

Figure 9:
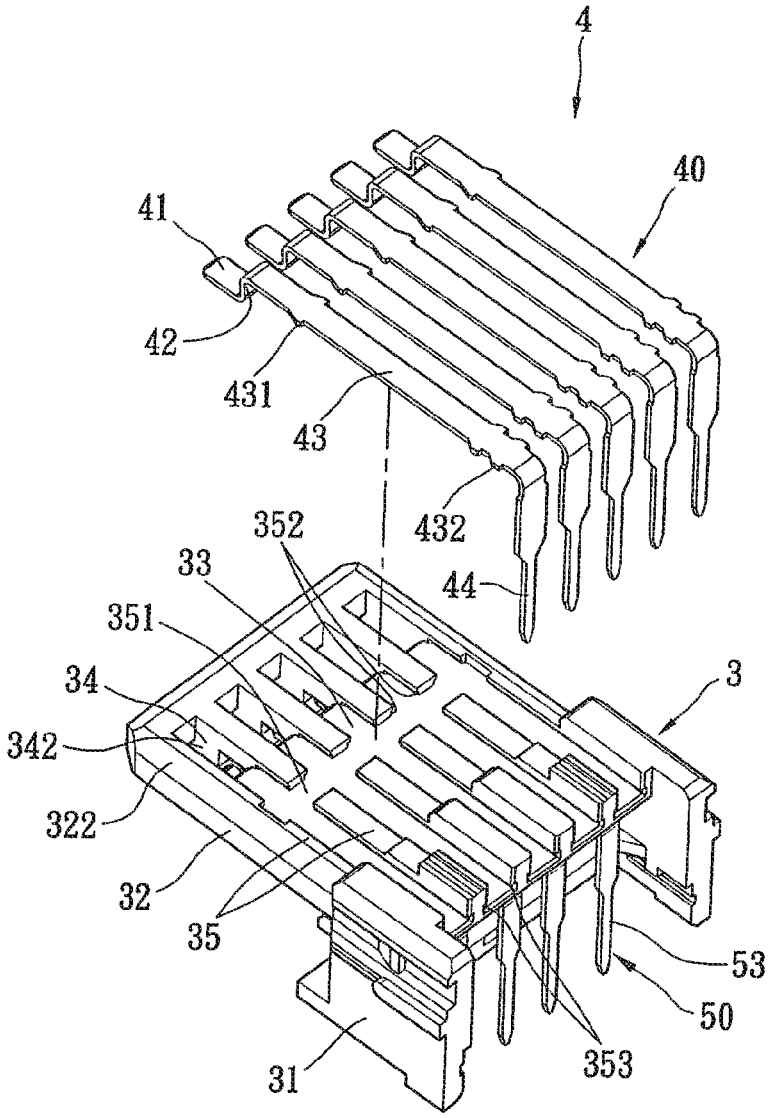
FIG. 9 is an assembled view (1) of the insulative body and the conduction terminals of a connector in a preferred embodiment, wherein the second conduction terminals have been assembled to the insulative body.
Figure 14:
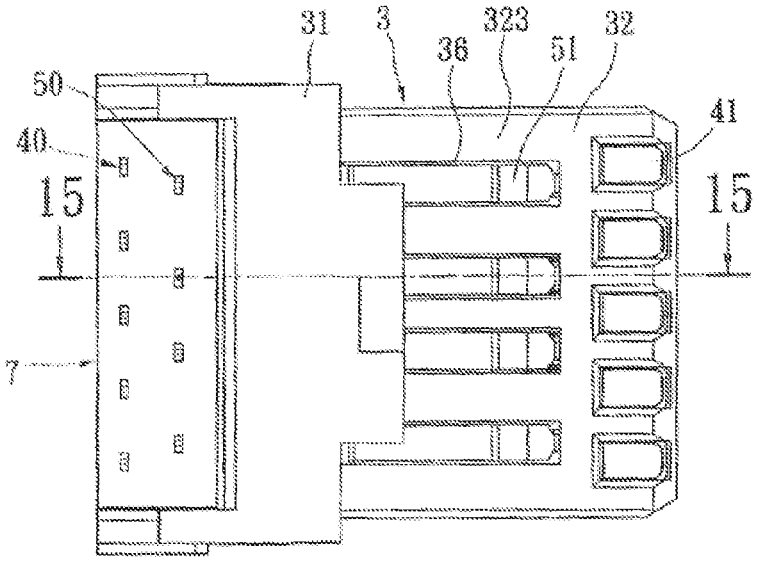
FIG. 14 is a bottom view of assembled insulative body and conduction terminals of a connector in a preferred embodiment.
Figure 15:
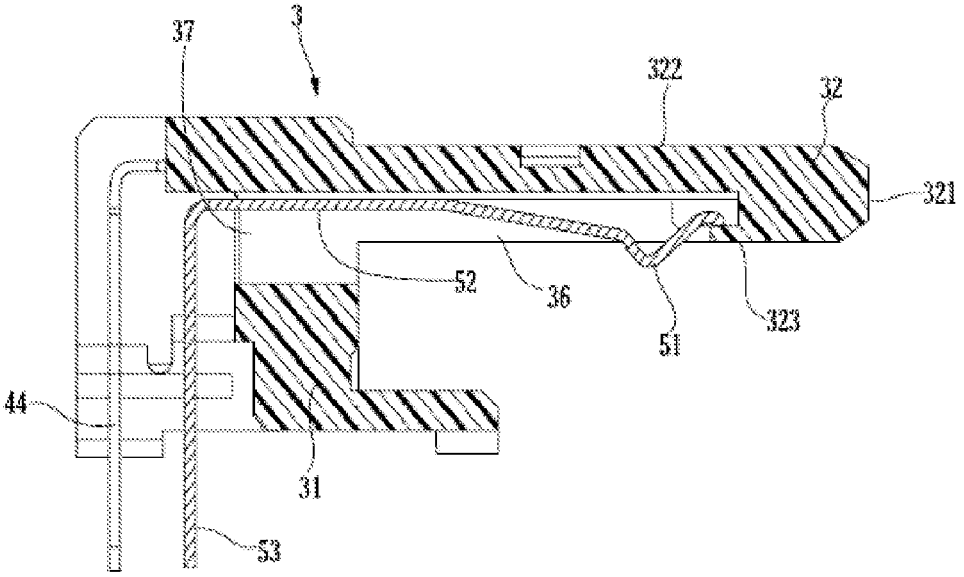
FIG. 15 is a sectional view along the line 15-15 in FIG. 14 with the positioning base removed.

The conduction terminals 4 are disposed on the insulative body 3, and along the extension direction of the tongue panel 32, the first conduction terminals 40 are disposed in the front row, while the second conduction terminals 50 are disposed in the back row. As shown in FIG. 8 and FIG. 9, in the assembly process, the second conduction terminals 50 can be first assembled, the second conduction terminals 50 are inserted from the rear of the insulative body 3 to the fixing holes 37, and further pushed forward such that the second fixing portions 52 are fixed inside corresponding fixing holes 37, and the second contact portions 51 are received inside the second receiving slots 36 of the insulative body 3 such that the second contact portions 51 are installed on the second surface 323 of the tongue panel 32 (as shown in FIG. 14 and FIG. 15).

Subsequently, these first conduction terminals 40 can be inserted from above the first surface 322 of the tongue panel 32 downwardly into the recess portions 34 of the tongue panel 32, and pushed further forward to be installed to said tongue panel 32 (refer to the imaginary line in FIG. 13), such that the first fixing portions 43 are received inside corresponding first receiving slots 33, and such that the first contact portions 41 run through corresponding openings 342 of the recess portions 34 from the first surface 322 and then are inserted and installed into the grooves 38 of the second surface 323 of the tongue panel 32.

Figure 10:
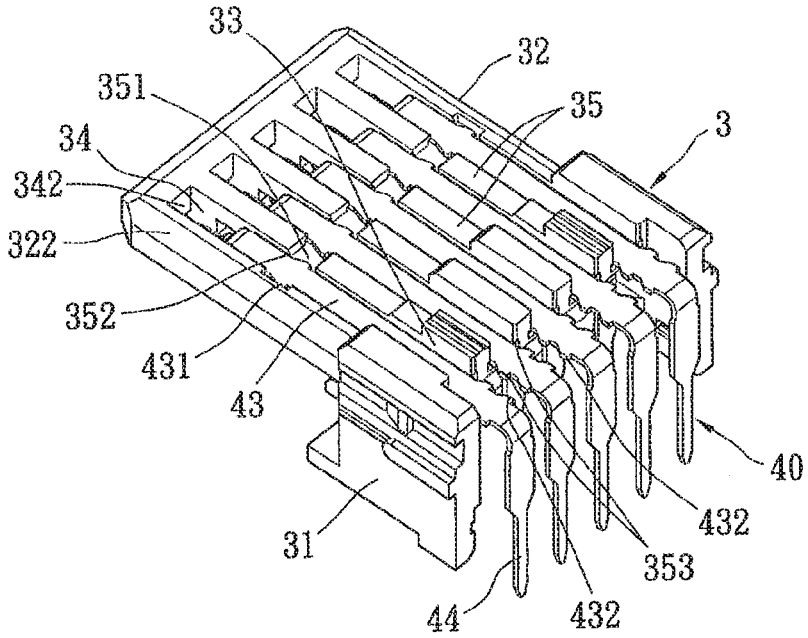
FIG. 10 is an assembled view (2) of the insulative body and the conduction terminals of a connector in a preferred embodiment, illustrating a state in which the first conduction terminals have not been pushed forward and locked onto the insulative body.
Figure 11:
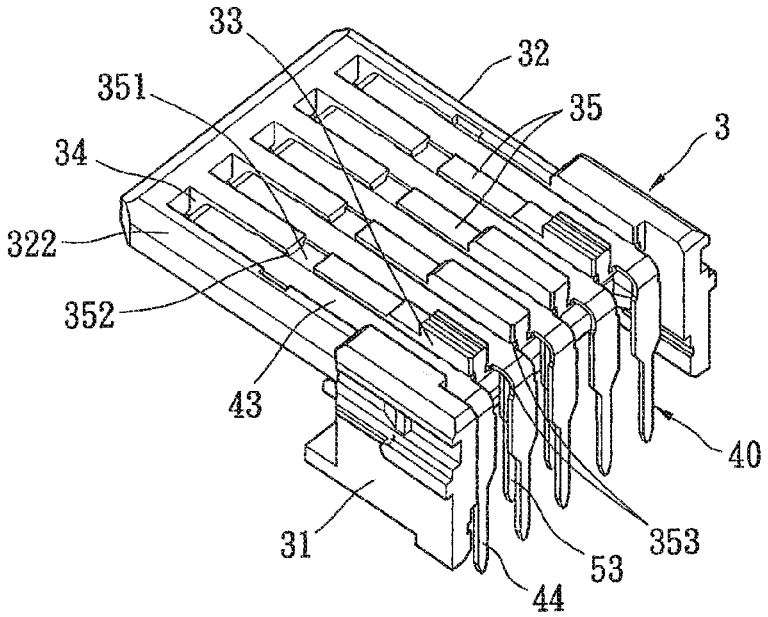
FIG. 11 is an assembled view (3) of the insulative body and the conduction terminals of a connector in a preferred embodiment, illustrating a state in which the first conduction terminals have been locked onto the insulative body.
Figure 12:
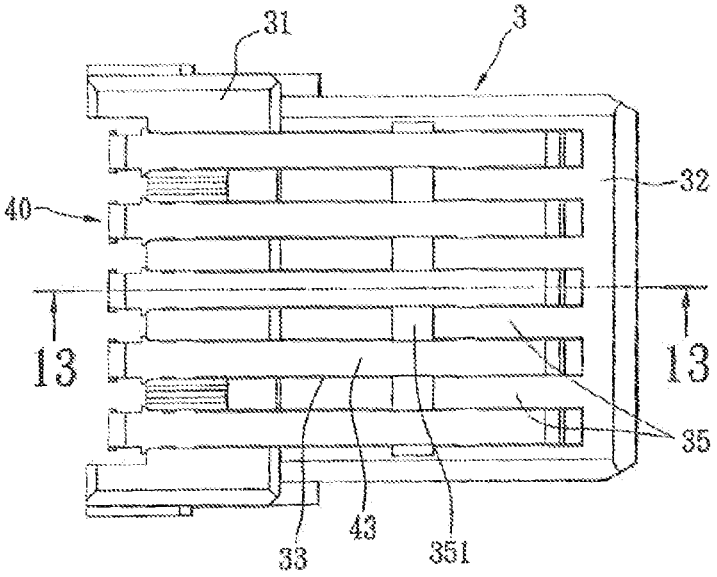
FIG. 12 is a top view of assembled insulative body and conduction terminals of a connector in a preferred embodiment.
Figure 13:
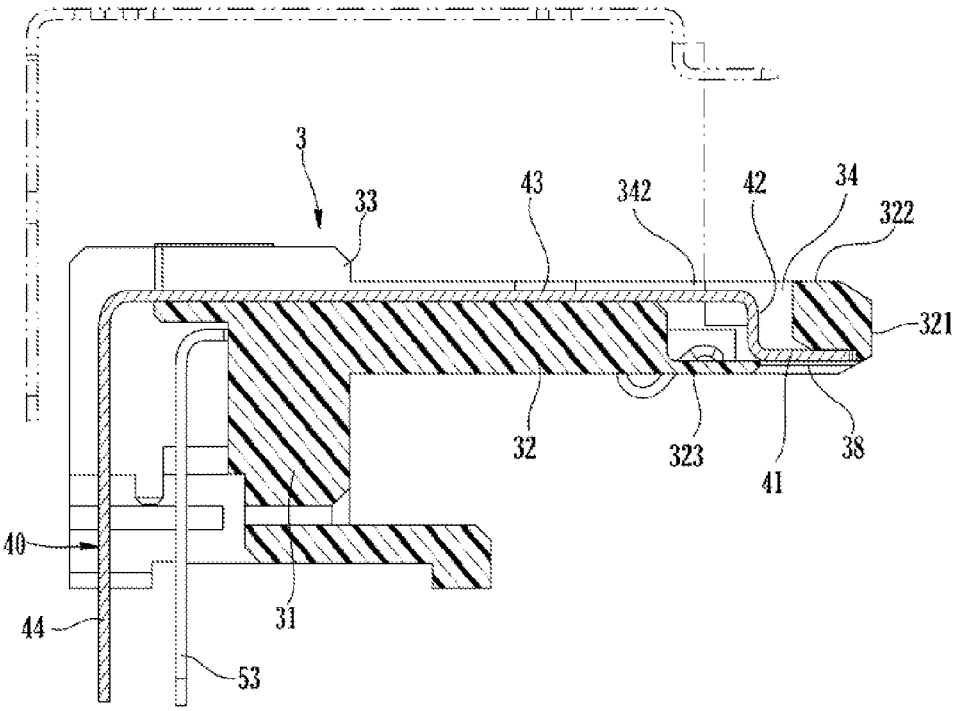
FIG. 13 is a sectional view along the line 13-13 in FIG. 12.

Preferably, in the assembly process, as shown in FIG. 9 through FIG. 11, the front spurs 431 of the first fixing portions 43 are aligned with the notches 351 and inserted into the first receiving slots 33 from up down via the notches 351, and then push forward the first conduction terminals 40, namely make the front spurs 431 move to the direction of the front groove 352, such that the front spurs 431 and the rear spurs 432 of the first fixing portions 43 are locked correspondingly into the front grooves 352 and the rear grooves 353 to fix the first conduction terminals 40. At the same time, when the first conduction terminals 40 are pushed forward, as shown in FIG. 12 and FIG. 13, the first contact portions 41 are pushed forward into the grooves 38 such that the grooves 38 receive corresponding first contact portions 41. Different changes can be made herein, e.g. forming only one spur (i.e. rear spur) on the first fixing portion, also forming only one groove (i.e. rear groove) on two side walls that form the first receiving slot such that the spur of the first fixing portion is locked inside the groove.

Moreover, the front end of the opening 342 of the recess portion 34 on the first surface 322 is of a closed structure, and the opening 342 of the recess portion 34 is bigger than the first contact portion 41 of the first conduction terminal 40 for the first contact portion 41 to run from up down through the opening 342 of the recess portion 34 and then to be fixed onto the second surface 323 of the tongue panel 32. Secondly, the bending portion 42 of the first conduction terminal 40 is contained in a corresponding recess portion 34 and is completely shielded at the front by the front end surface 321 of the tongue panel 32 to be in a nearly parallel configuration with the front end surface 321 of the tongue panel 32.

Please refer to FIG. 5 and FIG. 6 again, the positioning base 7 is fixed at the rear end of the insulative body 3, the first welding portion 44 and the second welding portion 53 of the first conduction terminal 40 and the second conduction terminal 50 are inserted into corresponding positioning slots 71 with the ends thereof extending out of the positioning slots 71.

The shielding shell 6 wraps around the peripheral surface of the insulative body 3, and the backboard 62 covers the positioning base 7. Moreover, the shielding shell 6 forms a plug-in space 63 having a socket 631, the tongue panel 32, as well as the first contact portions 41 and the second contact portions 51 of the conduction terminals 4, are correspondingly disposed inside the plug-in space 63 for another connector (not shown) to be inserted into the plug-in space 63 through the socket 631 so as to contact the first contact portions 41 or the second contact portions 51. The first conduction terminals 40 are used to transmit USB3.0 signals, while the second conduction terminals 50 are used to transmit USB2.0 signals.

According to the above description, with the assembly structure between the recess portions of the insulative body and the first contact portions of the first conduction terminals, the depicted disclosure keeps the first conduction terminals from being exposed at the front end surface of the tongue panel, which can prevent ESD. Secondly, the first contact portion, the bending portion, the first fixing portion and the first welding portion of the first conduction terminal are connected end to end with their axis lines all on the same plane defined by the front to back extension direction and the up to down extension direction of the first conduction terminals, such that when the first conduction terminals are pressed and bent from a metal band, the horizontal distance between two neighboring first terminals can be reduced to improve the material utilization rate of the metal band, and the horizontal distance between two neighboring first terminals on the metal band at pressing can be designed the same as the horizontal distance between two neighboring first terminals when they are installed to the insulative body, such that during assembly, five first conduction terminals can be assembled to the insulative body together through a continuous metal band, making the assembly further convenient.

The above description is directed to preferred and exemplary embodiments and is not intended to limit the scope of the present disclosure. Therefore, all equivalent structural changes made according to specifications and drawings herein shall be encompassed into the scope defined by claims herein.

The invention claimed is:

1. A connector, comprising an insulative body, a plurality of conduction terminals disposed on the insulative body, and a shielding shell that wraps around the peripheral surface of the insulative body; the insulative body comprises a main body and a tongue panel, the tongue panel comprises a front end surface that is far away from the main body, a first surface perpendicular to the front end surface, and a second surface opposite the first surface; the conduction terminals are arranged, in the extension direction of the tongue panel, as first conduction terminals in the front row and second conduction terminals in the back row, the first conduction terminals comprising a flat panel-like first contact portion, a bending portion bent and extended from the rear edge of the first contact portion, a first fixing portion extended from the end of the bending portion, and a first welding portion bent and extended from the rear edge of the first fixing portion, the second conduction terminals comprising an elastic second contact portion, a second fixing portion, and a second welding portion, and the first contact portion and the second contact portion are disposed on the second surface of the tongue panel, wherein the first surface of the tongue panel is provided with a plurality of first receiving slots for receiving the first fixing portions of the first conduction terminals and a plurality of recess portions disposed at the front end of the first receiving slots and open to the second surface, wherein the recess portion is formed as an opening on the first surface, and the opening is bigger than the first contact portion of the first conduction terminal for the first contact portion of the first conduction terminal to run through the opening of the recess portion from the first surface to be fixed onto the second surface of the tongue panel.

2. The connector of claim 1, wherein the bending portion of the first conduction terminal is contained in a corresponding recess portion and the bending portion is in a nearly parallel configuration with the front end surface of the tongue panel.

3. The connector of claim 2, wherein the first contact portion, the bending portion, the first fixing portion and the first welding portion of the first conduction terminal are connected end to end with the axis lines of the first contact portion, the bending portion, the first fixing portion and the first welding portion all on a single plane defined by a front to back extension direction.

4. The connector of claim 1, wherein spurs are formed by projecting from two sides of the first fixing portions of the first conduction terminals, grooves are formed on two side walls that form the first receiving slots, and the spurs of the first fixing portions are locked inside the grooves.

5. The connector of claim 1, wherein front spurs and rear spurs that are opposite to each other are formed by projecting from two sides of the central portions and the rear ends of the first fixing portions of the first conduction terminals, a plurality of raised strips are disposed by extending in a front to back direction on the first surface of the tongue panel, the above first receiving slots are formed between these raised strips, a notch is formed in the central portion of each of these raised strips, two side walls of the first receiving slots are provided with a front groove and a rear groove at front and rear ends of the notches that are opposite to each other, and the front spurs and rear spurs of the first fixing portions are locked correspondingly inside the front grooves and rear grooves.

6. The connector of claim 1, wherein the front end surface of the tongue panel of the insulative body is of a closed structure that is not open to the plurality of recess portions.

7. The connector of claim 1, wherein the second surface of the tongue panel is provided with a plurality of grooves for receiving the first contact portions, and the recess portions are open to corresponding grooves at the front end of the second surface.

8. The connector of claim 7, wherein the openings of the recess portions of the tongue panel at the front end surface of the tongue panel are of a closed structure.

9. The connector of claim 8, wherein front spurs and rear spurs that are opposite to each other are formed by projecting from two sides of the central portions and the rear ends of the first fixing portions of the first conduction terminals, a plurality of raised strips are disposed by extending in a front to back direction on the first surface of the tongue panel, the above first receiving slots are formed between these raised strips, a notch is formed in the central portion of each of these raised strips, two side walls of the first receiving slots are provided with a front groove and a rear groove at front and rear ends of the notches that are opposite to each other, and the front spurs and rear spurs of the first fixing portions are locked correspondingly inside the front grooves and rear grooves.

10. The connector of claim 1, wherein the insulative body is further provided with a plurality of fixing holes and the second surface of the tongue panel is provided with second receiving slots that are open to the fixing holes, the second fixing portions of the second conduction terminals are fixed inside corresponding fixing holes, and the contact portions are received inside corresponding second receiving slots.

11. The connector of claim 10, wherein the second surface of the tongue panel is provided with a plurality of grooves for correspondingly receiving the first contact portions, the recess portions are of a partially closed structure on the second surface with the front ends thereof open to the corresponding grooves and the rear ends thereof partially open to neighboring second receiving slots.

* * * * *